US011311989B2

(12) United States Patent
Wu

(10) Patent No.: US 11,311,989 B2
(45) Date of Patent: Apr. 26, 2022

(54) WARNING DEVICE FOR A TORQUE ADJUSTOR OF A TORQUE WRENCH

(71) Applicant: Matatakitoyo Tool Co., Ltd., Taichung (TW)

(72) Inventor: Yi-Min Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 174 days.

(21) Appl. No.: 16/914,450

(22) Filed: Jun. 28, 2020

(65) Prior Publication Data

US 2021/0402576 A1 Dec. 30, 2021

(51) Int. Cl.
*B25B 23/142* (2006.01)
*B25B 23/14* (2006.01)
*B25B 23/16* (2006.01)

(52) U.S. Cl.
CPC ..... *B25B 23/1427* (2013.01); *B25B 23/141* (2013.01); *B25B 23/16* (2013.01)

(58) Field of Classification Search
CPC ..... B25B 23/00; B25B 23/14; B25B 23/1405; B25B 23/1427; B25B 23/141; B25B 23/16; Y10S 901/47; G01L 1/247; A61B 5/0048; G05G 1/10
USPC ..... 81/475, 473; 116/200, 223, 284, 299, 116/306, 334–337, DIG. 41
See application file for complete search history.

(56) References Cited

U.S. PATENT DOCUMENTS 11,052,517 B2 * 7/2021 Hsieh ..... B25B 23/0007

FOREIGN PATENT DOCUMENTS

DE 202007008522 * 8/2007 ..... B25B 23/142

* cited by examiner

*Primary Examiner* — Joseph J Hail
*Assistant Examiner* — Robert C Moore
(74) *Attorney, Agent, or Firm* — Bruce Stone LLP; Joseph A. Bruce

(57) ABSTRACT

A torque wrench includes a handle, a wrench, a clutch, an adjustor, a grip, a scale ring and a locking collar. The wrench includes a lever inserted in and pivotally connected to the handle. The clutch is connected to the lever to stop rotating a workpiece when a maximum value of torque is reached. The adjustor is connected to the clutch and includes a knob operable to adjust the maximum value of torque. The knob is provided with a first color. The grip is connected to the handle. The scale ring is connected to the grip. The locking collar is provided with a second color. The locking collar is movable between a locking position to prevent the knob from rotation relative to the grip and show the first color and an unlocking position to allow the knob to rotate relative to the grip and show the second color.

12 Claims, 6 Drawing Sheets

WARNING DEVICE FOR A TORQUE ADJUSTOR OF A TORQUE WRENCH

BACKGROUND OF INVENTION

1. Field of Invention

The present invention relates to a torque wrench and, more particularly, to a warning device for a torque adjustor of a torque wrench.

2. Related Prior Art

A maximum of torque transferable through a torque wrench is adjustable. In use of the torque wrench to rotate a nut or a threaded bolt, the torque wrench protectively stops rotating the nut or threaded bolt when the maximum value of torque is reached. A typical torque wrench includes a wrench, a handle, a ball, a pusher, a spring and an adjustor. The wrench includes a head formed at a front end of a lever. The handle is a tubular element connected, at an end, to a grip. The lever is inserted in and pivotally connected to the handle. The ball, the pusher and the spring are also inserted in the handle. A notch is made in a rear end of the lever. A notch is made in a front end of the pusher. The ball includes a portion inserted in the notch of the lever and another portion inserted in the notch of the pusher, i.e., the ball is located between the rear end of the lever and the front end of the pusher. The spring is compressed between a rear end of the pusher and a front end of the adjustor. The adjustor is operable to adjust how much the spring is compressed. Thus, the maximum value of torque is adjustable. However, the adjustor could accidentally be operated to change the maximum value of torque, and this is not desirable.

To avoid the foregoing problem, there is a need for a locking device for locking the adjustor. Moreover, there is a need for a signaling device for signaling the status of the adjustor, i.e., locked or unlocked.

The present invention is therefore intended to obviate or at least alleviate the problems encountered in the prior art.

SUMMARY OF INVENTION

It is the primary objective of the present invention to provide a torque wrench of which the status can be shown.

To achieve the foregoing objective, the torque wrench includes a handle, a wrench, a clutch, an adjustor, a grip, a scale ring and a locking collar. The wrench includes a lever inserted in and pivotally connected to the handle. The clutch is connected to the lever to stop rotating a workpiece when a maximum value of torque is reached. The adjustor includes a sleeve, a rod and a knob. The sleeve is abutted against the clutch and includes teeth. The rod includes teeth engaged with the teeth of the sleeve. The knob is operable to rotate the rod to translate the sleeve to adjust the maximum value of torque. The knob includes a rear section provided with a first color. The grip is connected to the handle. The scale ring is connected to the grip. The locking collar is movable between a locking position to prevent the knob from rotation relative to the grip and an unlocking position to allow the knob to rotate relative to the grip. The first color is shown and the second color is concealed by the scale ring when the locking collar is in the locking position. The second color is shown and the first color is concealed by the locking collar when the locking collar is in the unlocking position.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
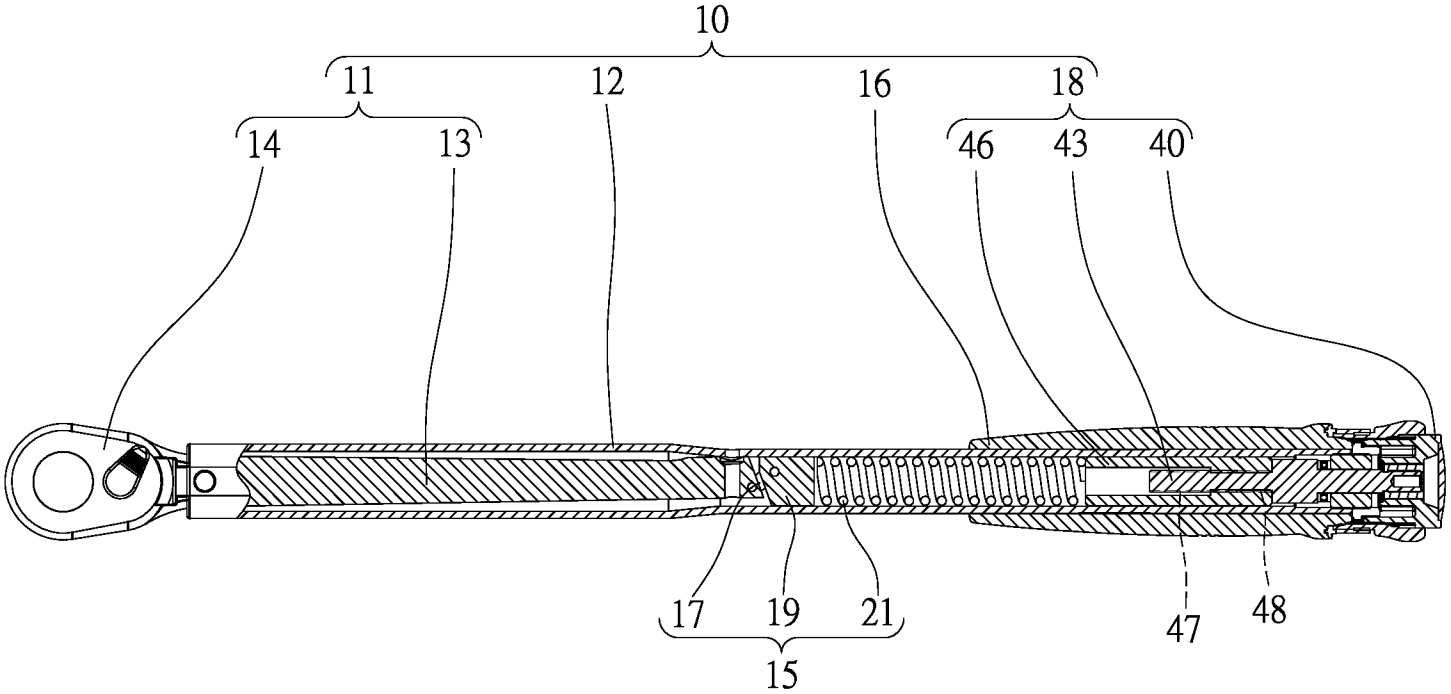
FIG. 1 is a perspective view of a torque wrench assembly according to the first embodiment of the present invention.

Referring to FIG. 1, a torque wrench 10 includes a wrench 11, a handle 12, a clutch 15, an adjustor 18, a locking collar 33 and a signaling device (not numbered) according to a first embodiment of the present invention. The wrench 11 includes a head 14 formed at a front end of a lever 13. The handle 12 is a tubular element. The lever 13 is substantially inserted in and pivotally connected to the handle 12. The torque wrench is operable to rotate a nut or a threaded bolt. A grip 16 is connected to an end of the handle 12 so that the grip 16 is not rotatable relative to the handle 12.

The clutch 15 is inserted in the handle 12. The clutch 15 includes two linking elements 17, a pusher 19 and a spring 21. At a front end, the pusher 19 includes an inclined face (not numbered) corresponding to an inclined face formed at rear end of the lever 13. The lever 13 is pivotally connected to the pusher 19 by the linking elements 17. The spring 21 is compressed between a rear end of the pusher 19 and a front end of the adjustor 18. The adjustor 18 is connected to the handle 12 or the grip 16. Thus, the clutch 15 is movable between a clutched position and an unclutched position. Before a maximum value of torque is reached, the clutch 15 is kept in the clutched position where the inclined face of the pusher 19 abuts against the inclined face of the lever 13 to transmit torque. Once the maximum value of torque is reached, the clutch 15 is moved to the unclutched position where the inclined face of the pusher 19 is detached from the inclined face of the lever 13 by the linking elements 17 to protectively stop transmitting the torque to the nut or threaded bolt from the torque wrench 10.

The adjustor 18 includes a knob 40, a rod 43 and a sleeve 46. The knob 40 is rotationally inserted in the grip 16. The knob 40 is connected to a rear end of the rod 43. The knob 40 and the rod 43 are allowed to rotate but not translate. The sleeve 46 is allowed to translate but not rotate. The rod 43 includes a thread 47 engaged with a thread 48 formed on an internal face of the sleeve 46 so that the rotation of the rod 43 causes the translation of the sleeve 46. The spring 21 is compressed between a front end of the sleeve 46 and the rear end of the pusher 19. Thus, the adjustor 18 is operable to adjust the maximum value of torque by adjusting how much the spring 21 is compressed.

Figure 2:
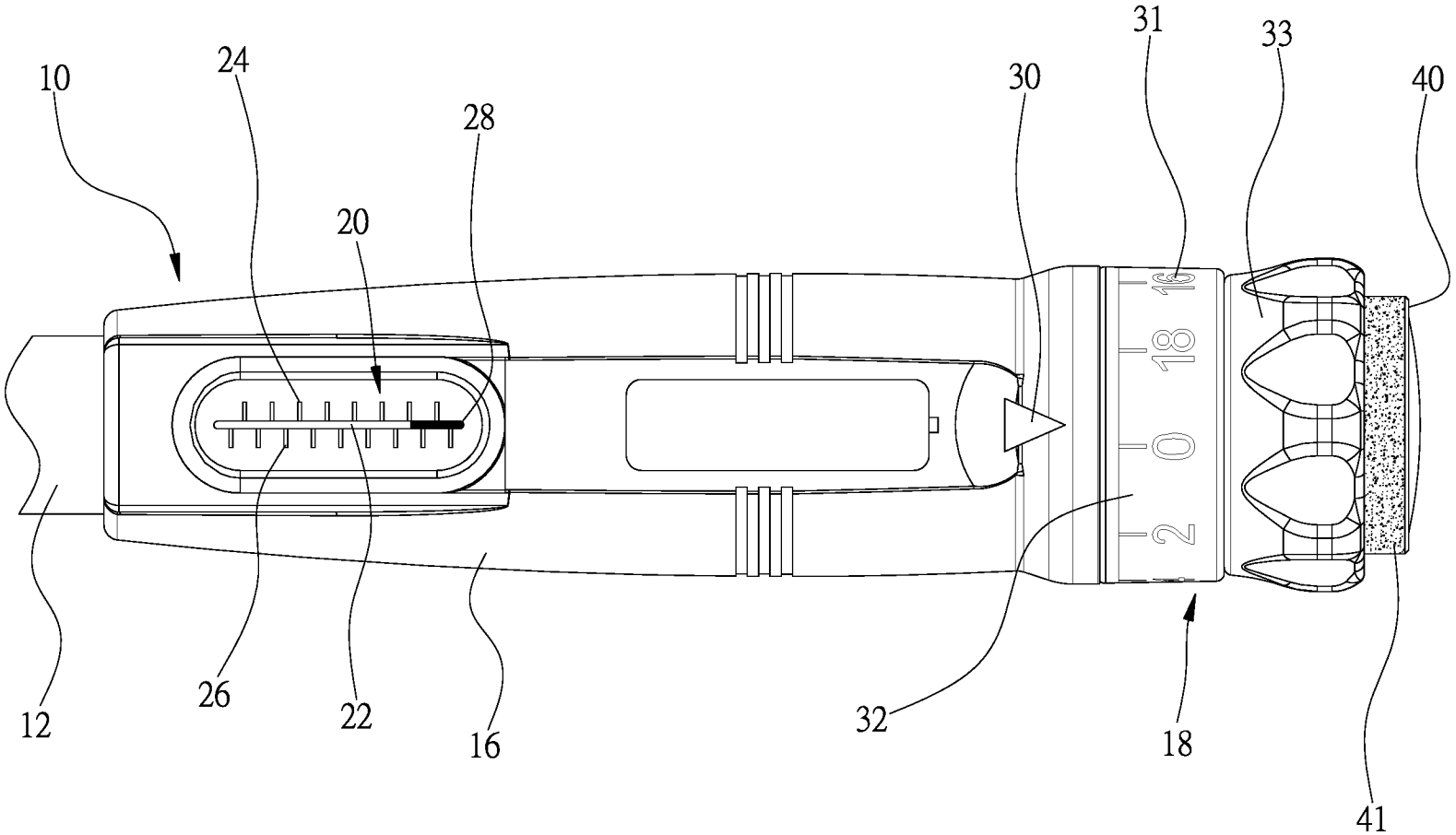
FIG. 2 is an enlarged partial side view of the torque wrench assembly shown in FIG. 1.

Referring to FIG. 2, the adjustor 18 further includes an indicator 20 including a rectilinear window 22 formed on the grip 16. A scale 24 is located on a side of the rectilinear window 22. A scale 26 is located on another side of the rectilinear window 22. A colored section 28 is provided on an external face of the sleeve 46 so that they are movable together. The colored section 28 of the sleeve 46 is used an indicator observable through the rectilinear window 22. Digits of the maximum value of torque in a metric unit before a decimal point are observable on the scale 24. Digits of the maximum value of torque in an imperial unit before the decimal point are observable on the scale 26.

The adjustor 18 further includes an arrow head 30 and a scale ring 32. The arrow head 30 is printed or formed on the grip 16, near a rear end of the grip 16. The scale ring 32 is located next to the rear end of the grip 16. A scale 31 is printed or formed on an external face of the scale ring 32. The scale 31 includes numbers representing digits of the maximum value of torque after the decimal point. Thus, the digits before and after the decimal point are observable to precisely show the maximum value of torque.

Figure 3:
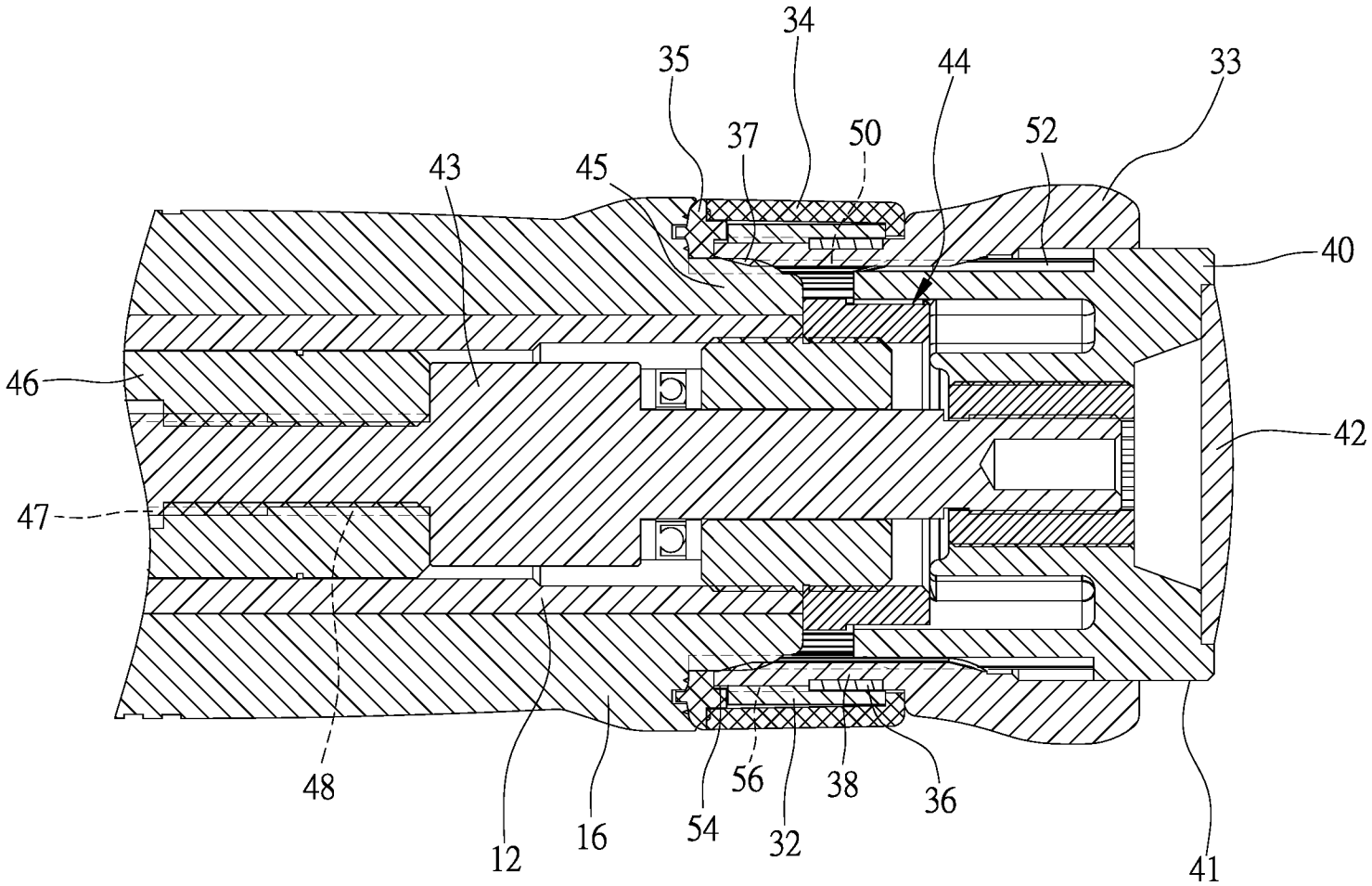
FIG. 3 is a cross-sectional view of the torque wrench assembly shown in FIG. 2.
Figure 4:
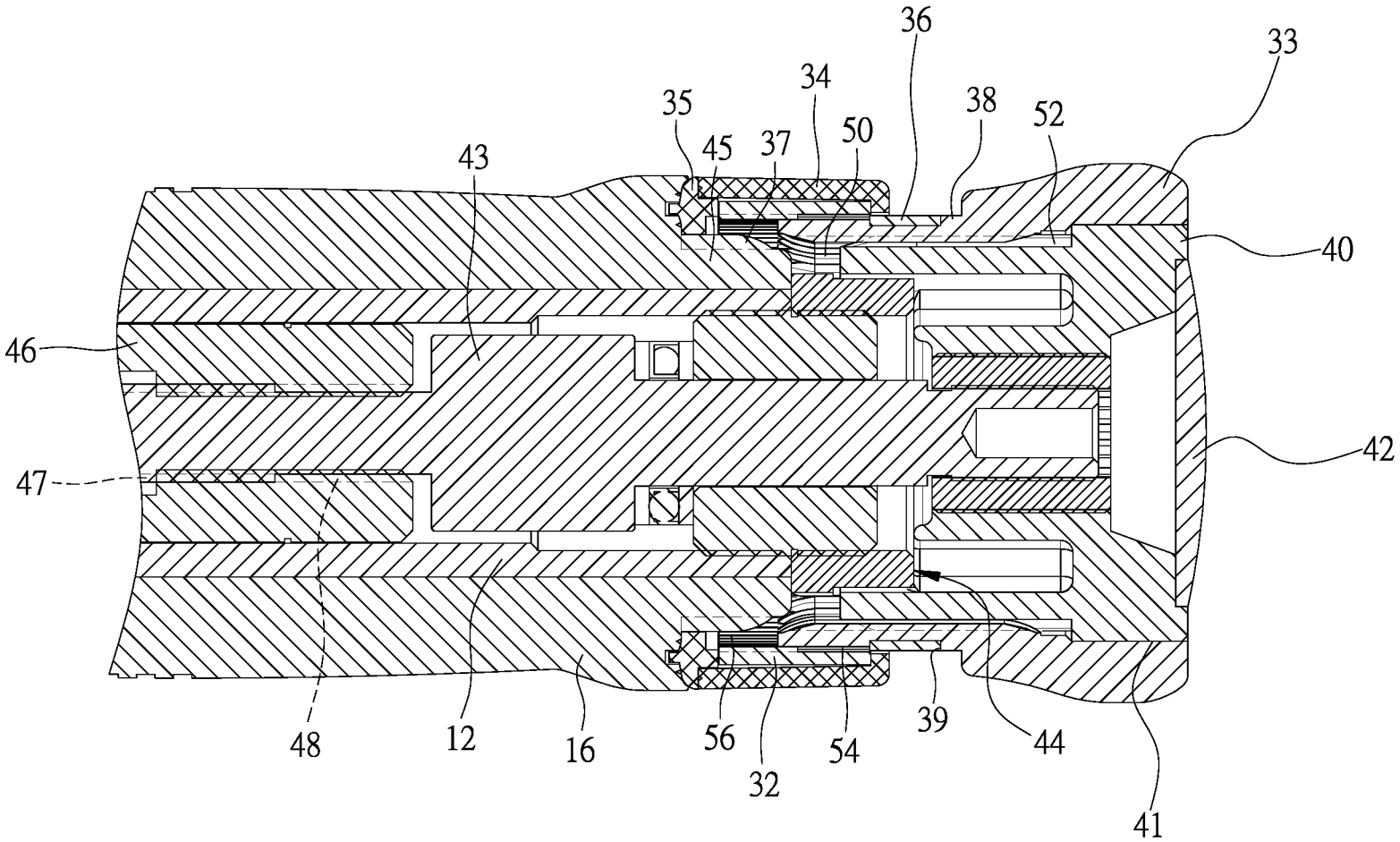
FIG. 4 is a cross-sectional view of the torque wrench assembly in another position than shown in FIG. 3.

Referring to FIGS. 3 and 4, the locking collar 33 is used to lock the knob 40 relative to the grip 16, i.e., prevent adjustment of the maximum value of torque. To this end, the locking collar 33 is formed with teeth 50 on an internal face. The knob 40 includes teeth 52 formed on an external face. The grip 16 includes teeth 37 formed on an external face of a reduced section 45.

Referring to FIG. 3, the locking collar 33 is in a locking position. The teeth 50 of the locking collar 33 are engaged with both the teeth 52 of the knob 40 and the teeth 37 of the grip 16. Thus, the locking collar 33 prevents the knob 40 from rotation relative to the grip 16. Hence, adjustment of the maximum value of torque is prevented.

Figure 5:
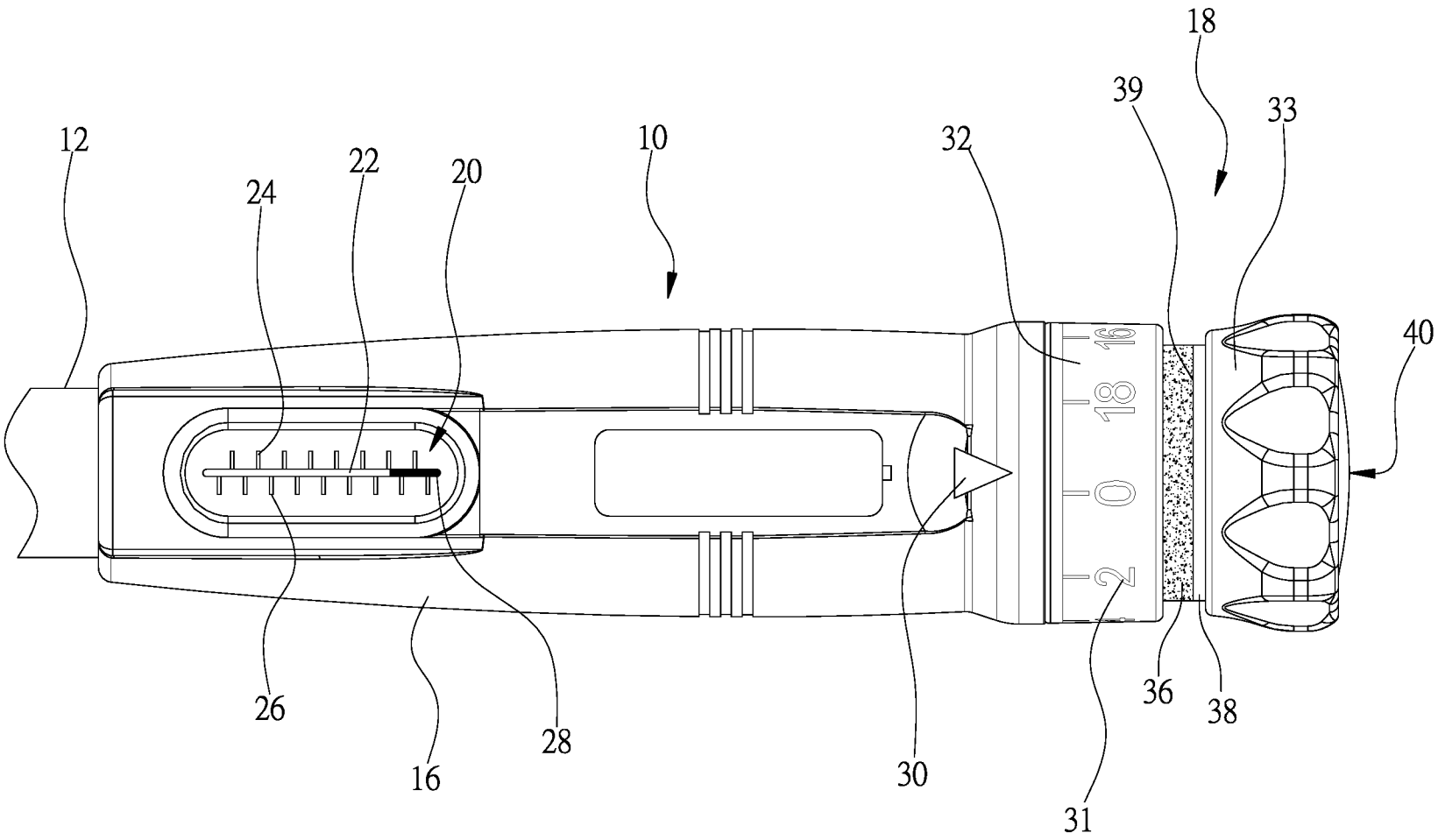
FIG. 5 is a side view of the torque wrench assembly of FIG. 4.

Referring to FIGS. 4 and 5, the locking collar 33 is in an unlocking position. The teeth 50 of the locking collar 33 are disengaged from the teeth 37 of the grip 16. Thus, the locking collar 33 allows the knob 40 to rotate relative to the grip 16. Hence, adjustment of the maximum value of torque is allowed. Accordingly, use of the torque wrench 10 to rotate a threaded bolt or a nut is not preferred now.

The locking collar 33 includes a front section 38 and a rear section (not numbered). An external diameter of the front section 38 of the locking collar 33 is smaller than an external diameter of the rear section of the same. The front section 38 of the locking collar 33 is inserted in the scale ring 32. The front section 38 of the locking collar 33 is formed with teeth 54 on an external face. The scale ring 32 is formed with teeth 56 on an internal face. The teeth 54 of the locking collar 33 are engaged with the teeth 56 of the scale ring 32 so that they are not rotatable relative to each other but translatable relative to each other. The rear section of the collar 33 is located next to the scale ring 32.

To signal that the collar 33 is in the locking position or in the unlocking position, i.e., adjustment of the maximum value of torque is prevented or allowed, two colors are used. To this end, a first color is provided on a rear section 41 of the knob 40. A second color is provided on the front section 38 of the locking collar 33. When the collar 33 is in the locking position, the rear section 41 of the knob 40 is located out of the locking collar 33, and the front section 38 of the locking collar 33 is covered by the scale ring 32. Hence, the first color is shown, and the second color is concealed. When the collar 33 is in the unlocking position, the rear section 41 of the knob 40 is covered by the locking collar 33, and the front section 38 of the locking collar 33 is located out of the scale ring 32. Thus, the second color is shown, and the first color is concealed.

Preferably, the first color is the color of the material used to make the knob 40. In another embodiment, the first color can be the color of a sticker, film or any other proper element adhered to the rear section 41 of the knob 40. The first color is red, yellow or any other bright color.

The second color is the color of a color ring 36 extending around the front section 38 of the locking collar 33. Preferably, the color ring 36 is a ferrule fitted in a groove 39 made in the external face of the front section 38 of the locking collar 33. In another embodiment, the color ring 36 can be paint filled in the groove 39. The second color is green, blue or any other dark color in strong contrast with the first color.

Referring to FIG. 3, a spacer 44 is located between the grip 16 and the knob 40 in a stationary manner. Thus, the knob 40 is kept from the grip 16 by a proper distance to allow the rear section 41 to stick out of the locking collar 33. A rod 43 extends through the spacer 44 and is connected to the knob 40. A cover 42 is used to cover the knob 40 to keep dust, dirt or the like out of the interior of the knob 40.

A lens 34 covers the scale ring 32. The lens 34 is connected to the grip 16 via a connector 35 so that the lens 34 is not rotatable or translatable relative to the grip 16. The lens 34 includes an internal annular flange (not numbered) in contact with an annular edge (not numbered) of the scale ring 32. Thus, the lens 34 prevents the scale ring 32 from translation with the locking collar 33 but allows rotation of the scale ring 32 with the locking collar 33 around the reduced section 45 of the grip 16.

Figure 6:
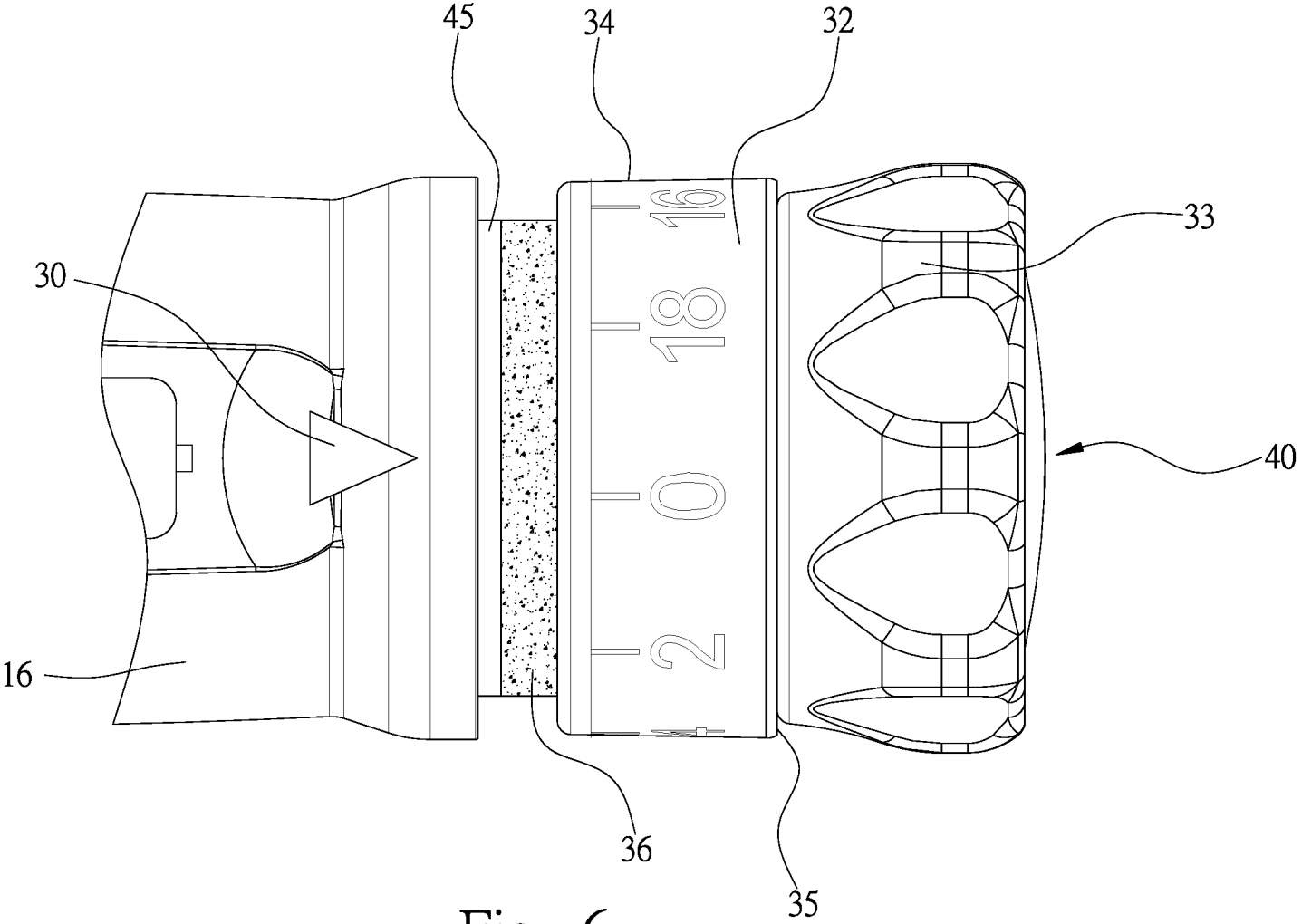
FIG. 6 is a partial side view of a torque wrench assembly according to the second embodiment of the present invention.

Referring to FIG. 6, there is shown a torque wrench 10 in accordance with a second embodiment of the present invention. The second embodiment is identical to the first embodiment of the present invention except for two things. Firstly, the color ring 36 extends around the reduced section 45 of the grip 16 instead of the front section 38 of the locking collar 33. Secondly, the connector 35 connects the lens 34 to the locking collar 33 instead of the grip 16. The lens 34 holds the scale ring 32 to allow the scale ring 32 to translate and rotate with the locking collar 33.

When the locking collar 33 is in the unlocking position, the color ring 36, which extends around the reduced section 45 of the grip 16, is located out of the scale ring 32. Hence, the second color, which is provided on the color ring 36, is visible.

When the locking collar 33 is in the locking position, the color ring 36, which extends around the reduced section 45 of the grip 16, is covered by the scale ring 32. Hence, the second color, which is provided on the color ring 36, is invisible. Now, the rear section 41 of the knob 40 is located out of the locking collar 33. Hence, the first color, which is provided on the rear section 41 of the knob 40, is visible.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. A torque wrench comprising:

a handle;

a wrench comprising a lever inserted in and pivotally connected to the handle;

a clutch connected to the lever to stop rotating a workpiece when a maximum value of torque is reached;

an adjustor comprising a sleeve formed with a thread and abutted against the clutch, a rod formed with a thread engaged with the thread of the sleeve, and a knob operable to rotate the rod to translate the sleeve to adjust the maximum value of torque, wherein the knob is provided with a first color;

a grip connected to the handle;

a scale ring connected to the grip; and a locking collar provided with a second color and movable between a locking position to prevent the knob from rotation relative to the grip and an unlocking position to allow the knob to rotate relative to the grip;

wherein the first color is shown and the second color is concealed by the scale ring when the locking collar is in the locking position;

wherein the second color is shown and the first color is concealed by the locking collar when the locking collar is in the unlocking position.

2. The torque wrench assembly according to claim 1, wherein the knob comprises a rear section provided with the first color, wherein the locking collar comprises a front section provided with the second color.

3. The torque wrench assembly according to claim 2, further comprising a color ring provided around the front section of the locking collar, wherein the second color is provided on the color ring.

4. The torque wrench assembly according to claim 3, wherein the front section of the locking collar comprises a groove for receiving the color ring.

5. The torque wrench assembly according to claim 2, wherein the front section of the locking collar is located between the scale ring and the grip in a radial direction when the locking collar is in the locking position.

6. The torque wrench assembly according to claim 1, wherein the grip comprises a lens for covering and holding the scale ring so that the scale ring is not translatable relative to the grip with the locking collar and that the scale ring is rotatable relative to the grip with the locking collar.

7. The torque wrench assembly according to claim 1, wherein the scale ring comprises numbers.

8. A torque wrench comprising:

a handle;

a wrench comprising a lever inserted in and pivotally connected to the handle;

a clutch connected to the lever to stop rotating a workpiece when a maximum value of torque is reached;

an adjustor comprising a sleeve formed with a thread and abutted against the clutch, a rod formed with a thread engaged with the thread of the sleeve, and a knob operable to rotate the rod to translate the sleeve to adjust the maximum value of torque, wherein the knob is provided with a first color;

a grip connected to the handle and provided with a second color;

a locking collar movable between a locking position to prevent the knob from rotation relative to the grip and an unlocking position to allow the knob to rotate relative to the grip; and a scale ring connected to the grip;

wherein the first color is shown and the second color is concealed by the scale ring when the locking collar is in the locking position;

wherein the second color is shown and the first color is concealed by the locking collar when the locking collar is in the unlocking position.

9. The torque wrench assembly according to claim 8, wherein the knob comprises a rear section provided with the first color, wherein the grip comprises a reduced section provided with the second color.

10. The torque wrench assembly according to claim 8, wherein a front section of the locking collar is inserted in the scale ring.

11. The torque wrench assembly according to claim 8, further comprising a color ring extending around the reduced section of the grip, wherein the second color is provided on the color ring.

12. The torque wrench assembly according to claim 8, wherein the scale ring comprises numbers.

* * * * *